US006869471B2

(12) United States Patent
Ödberg et al.

(10) Patent No.: US 6,869,471 B2
(45) Date of Patent: Mar. 22, 2005

(54) PROCESS FOR SIZING PAPER AND SIZING COMPOSITION

(75) Inventors: Lars Ödberg, Stockholm (SE); Rosa Mattsson, Piteå (SE); Pavol Barla, Göteborg (SE)

(73) Assignee: Akzo Nobel N.V., Arnhem (NL)

( * ) Notice: Subject to any disclaimer, the term of this patent is extended or adjusted under 35 U.S.C. 154(b) by 221 days.

(21) Appl. No.: 10/298,590

(22) Filed: Nov. 19, 2002

(65) Prior Publication Data

US 2003/0127205 A1 Jul. 10, 2003

Related U.S. Application Data

(60) Provisional application No. 60/331,555, filed on Nov. 19, 2001.

(51) Int. Cl.[7] ..... D21H 21/16; D21H 17/71

(52) U.S. Cl. ..... 106/287.24; 106/162.1; 106/287.2; 106/287.25; 162/158; 162/175; 162/181.3; 162/181.6

(58) Field of Search ..... 106/162.1, 287.2, 106/287.24, 287.25; 162/158, 175, 181.3, 181.6

(56) References Cited

U.S. PATENT DOCUMENTS

| | | | | |
|---|---|---|---|---|
| 3,887,427 A | | 6/1975 | Helmer | 162/158 |
| 4,522,686 A | | 6/1985 | Dumas | 162/158 |
| 4,657,946 A | | 4/1987 | Rende | 523/402 |
| 6,048,439 A | * | 4/2000 | Huang et al. | 162/168.1 |
| 6,159,339 A | | 12/2000 | Hassler | 162/158 |
| 6,284,099 B1 | | 9/2001 | Peutherer | 162/158 |
| 6,413,372 B1 | * | 7/2002 | Maliczyszyn et al. | 162/175 |

FOREIGN PATENT DOCUMENTS

| | | |
|---|---|---|
| EP | 1099795 | 5/2001 |
| WO | 97/49865 | 12/1997 |
| WO | 98/33979 | 8/1998 |
| WO | WO 00/34583 | 6/2000 |

* cited by examiner

*Primary Examiner*—David Brunsman
(74) *Attorney, Agent, or Firm*—White, Redway and Brown

(57) ABSTRACT

The present invention relates to a process for sizing paper comprising providing an aqueous suspension comprising cellulosic fibres, dewatering said aqueous suspension thereby forming a paper web, said process comprising adding to the cellulosic suspension an aqueous composition comprising aggregates comprising a sizing agent, the composition obtainable by mixing in any order prior to the addition to the aqueous suspension, (i) an aqueous solution comprising at least one coagulation agent, and (ii) an aqueous dispersion comprising a sizing agent, wherein the zeta potential of the composition is less than 20 mV. The invention also refers to an aqueous sizing composition.

26 Claims, No Drawings

PROCESS FOR SIZING PAPER AND SIZING COMPOSITION

This application claims the benefit of Provisional Application No. 60/331,555, filed Nov. 19, 2001.

The present invention refers to a process for sizing paper comprising adding to a cellulosic suspension an aqueous composition containing aggregates comprising a sizing agent, whereby the composition is formed by mixing in any order, an aqueous solution of a coagulation agent and an aqueous dispersion comprising a sizing agent wherein the zeta potential of the composition is less than 20 mV. The invention also encompasses an aqueous sizing composition.

BACKGROUND

In order to obtain a paper which is suited for printing and other commercial applications different kinds of performance chemicals are added to the cellulosic suspensions in the paper mill. One type of compounds which are added serve the purpose of rendering the paper more resistant to the penetration of liquids such as aqueous solutions and are commonly referred to as sizing agents. These sizing agents often contain hydrophobic moieties, whereby the compounds are either covalently bound to the cellulosic fibres or alternatively only associated to the fibres. The performance of the sizing agents which are usually added to the suspension in from of a dispersion or emulsion is influenced by numerous factors such as the type of pulp in the suspension, i.e. chemical pulp, mechanical pulp, recycled fibres, other performance additives like retention agent, and above all the amount of contaminants present in the suspension. Contaminants present in the suspension which have an effect on the retention of sizing agents are inter alia ionic compounds ranging from salts to polymers having a substantial molecular weight. The existence of charged polymeric compounds like xylanes in the suspension is often indicated by measuring the cationic demand of the suspension. A higher cationic demand signifies a higher concentration of charged polymeric compounds in the suspension. Suspensions with high cationic demands can originate from type of pulp used, i.e. recycled paper, diluting water used, and the degree of re-circulation of the white-water in the paper-mill. A paper-mill where the white-water is extensively re-circulated tend to end up with a suspension having a high cationic demand. Accordingly, one objective with the present invention is to provide a process for sizing paper, where the paper is formed from a suspension containing cellulosic fibres having a high cationic demand and/or a high conductivity. A further objective is to improve the retention of the sizing agent, specifically the so called first pass retention. The sizing composition according to the present invention may even render paper which is sufficiently sized without the additional addition of retention agents. Further objectives will be apparent hereinafter.

The sizing agent per se is a compound with a hydrophobic character, therefore, it is virtually impossible to disperse/emulsify the sizing agent in an aqueous solution without the presence of compounds which effect or facilitate the formation of a dispersion. In addition, further compounds may be required in order to stabilise the dispersion. The formation of a sizing dispersion prior to the addition of the sizing agent to the suspension is in principle a prerequisite in order to obtain a paper which is sufficiently sized. Normally, the particle size or the weight average particle size of the particles containing the sizing agent has an influence on the sizing efficiency. Better sizing according to common practice is achieved if the particles containing the sizing agent are as small as possible, suitable below 1 $\mu$m. However, the object with the present invention is to render a composition comprising aggregates containing the sizing agent which are substantially larger than sizing particles in conventional dispersions. It has surprisingly been shown that the process and composition according to the present invention renders a paper which is sufficiently sized, i.e. a Cobb-value below 30, even without the use of retention agents. In addition, the process and composition significantly improves sizing when applied to cellulosic suspensions having a high cationic demand and/or high conductivity.

In WO 00/34583 a sizing dispersion is disclosed which is stabilised by a cationic colloidal coacervate stabilising agent, where the coacervate agent contains an anionic component and a cationic component. The anionic and cationic components must be present in a proportion so that the zeta potential of the dispersion is at least 20 mV, though a zeta potential of at least 40 mV is more preferable. The objective with the coacervate agent is to stabilise the emulsified or dispersed sizing agent.

U.S. Pat. No. 6,159,339 refers to a paper size consisting essentially of ASA/AKD and degraded, liquid cationic starch.

WO 9833979 relates to an aqueous dispersion containing a cellulose-reactive sizing agent comprising a low molecular weight cationic organic compound having a molecular weight less than 10,000 and an anionic stabilizer.

INVENTION

The present invention refers to a process for sizing paper and a sizing composition according to the claims. More specifically, the present invention relates to a process for sizing paper comprising providing an aqueous suspension comprising cellulosic fibres, dewatering said aqueous suspension thereby forming a paper web, said process comprising adding to the cellulosic suspension an aqueous composition comprising aggregates comprising a sizing agent obtainable by mixing in any order prior to the addition to the aqueous suspension, (i) an aqueous solution comprising at least one coagulation agent, and (ii) an aqueous dispersion comprising a sizing agent, wherein the zeta potential of the composition is less than 20 mV. In addition, the invention also refers to an aqueous sizing composition as specified in the claims referring to an aqueous sizing composition containing aggregates comprising a sizing agent, wherein the composition is obtainable by mixing in any order (i) a solution comprising at least one coagulation agent, and (ii) an aqueous dispersion comprising a sizing agent, wherein the zeta potential of the composition is less than 20 mV.

According to a preferred embodiment of the present invention the aqueous composition comprising aggregates comprising a sizing agent is obtained by mixing in any order prior to the addition to the aqueous suspension (i) an aqueous solution comprising at least one charged coagulation agent, and (ii) a charged aqueous dispersion comprising a sizing agent, whereby the charge of the coagulating agent is opposite the charge of the dispersion.

According to yet another suitable embodiment the present invention refers to a process for sizing paper comprising adding the composition comprising aggregates comprising a sizing agent to the suspension without adding a retention agent or retention agents to said suspension.

The coagulation agent of the solution can virtually be any compound or mixture of compounds provided that said coagulation agent effects flocculation/agglomeration of the sizing particles when mixing the solution of the coagulation agent and the sizing agent dispersion. Suitably, the coagulation agent is selected from the group consisting of non-ionic polymers, polyelectrolytes, surfactants, silica-based particles, inorganic aluminium-containing compounds, and mixtures thereof. If charged coagulation agents are comprised in the aqueous solution then the aqueous sizing dispersion should preferably have the opposite charge.

Examples of suitable non-ionic polymers are polyalkylene oxides, also referred to as polyalkylene glycols, specifically polyethylene oxides and phenolic resins. The phenolic resins which can be selected are polycondensation products of phenols and aldehydes, preferably formaldehyde, commonly referred to as resols and novolacs, and phenolic resins modified by natural resins, i.e. rosin acids from e.g. gum rosin, wood rosin and tall-oil rosin. Usually, mixtures of polyalkylene oxides and phenolic resins are used as coagulating agent. It is favourable if the non-ionic polymers are water-soluble or water-dispersible.

According to the preferred embodiment mentioned above, the present invention is directed to a process for sizing paper and an aqueous sizing composition where an aqueous composition is formed by providing a charged aqueous dispersion or emulsion of a sizing agent (depending on the physical state of the sizing agent at ambient temperature), and an aqueous solution comprising a charged coagulation agent, wherein the charge of the coagulation agent is opposite the charge of the dispersion, mixing the dispersion and the solution thereby obtaining the aqueous composition comprising aggregates containing a sizing agent having a zeta potential of less than 20 mV. By the wording "charged aqueous dispersion" of the claims is also meant a charged aqueous emulsion depending on the type of sizing agent present in the dispersion. If, for example, a sizing agent is present which is solid or mostly solid at ambient temperature a dispersion is formed, however, if the sizing agent is liquid at ambient temperature an emulsion is obtained. The word "charged dispersion" refers to the overall charge of the dispersing/stabilising system of the dispersion. Accordingly, if the charged coagulation agent of the solution is anionic (overall anionic) then the dispersion comprising a sizing agent should be cationic; on the other hand, if the charged coagulation agent is cationic (overall cationic) then the dispersion should be anionic.

When referring to a charged coagulation agent of the solution, the charge is either positive or negative depending on the charge of the dispersion. Accordingly, the coagulation agent should not contain an equal amount of negative and positive charges. Thus, the charged coagulation agent is anionic or cationic, i.e. the agent may have an anionic or cationic overall charge, whereby the coagulation agent can have only anionic groups, solely cationic groups or both anionic and cationic groups, the latter referred to as amphoteric coagulation agents.

When forming the aqueous composition the order of mixing the solution with the dispersion does not seem to be of relevance. However, it is preferred that the solution comprising the coagulation agent is added to the aqueous dispersion. Any method of mixing the dispersion and the solution can be applied, though, suitably the addition of the solution is adjusted so that the zeta potential of the formed aqueous composition is less than about 20 mV during mixing thereby obtaining aggregates comprising the sizing agent having a diameter which is substantially larger than conventional sizing particles in a dispersion. Even better flocculation of the sizing agent is obtained if the zeta potential during mixing is around the iso-electric point of the composition, for example, less than about 18 mV (i.e. between −18 mV and +18 mV), more preferably less than about 15 mV (i.e. from between −5 mV and +5 mV).

According to the present invention the zeta potential of the obtained composition after mixing should be less than about 20 mV. The term less than about 20 mV encompasses a composition having a zeta potential less than 20 mV and more than −20 mV. The zeta potential of the composition is suitably less than about 18 mV, more preferably less than about 15 mV, suitably less than about 10 mV or even less than 5 mV. The zeta potential of the composition after mixing may even be as low as around the iso-electric point of the composition.

The charge of the aqueous composition, i.e. the dispersion/stabilising system is commonly verified by measuring the zeta potential. A positive value of the zeta potential indicates a cationic dispersion, whereas a negative zeta potential indicates an anionic dispersion. The zeta potential can be measured using particle micro electrophoresis as described in the text book "Introduction to colloid and surface chemistry", D. Shaw, Butterworths.

The aggregates comprising the sizing agent are loosely packed agglomerates with respect to the sizing agent where the sizing agent is evenly distributed within the aggregate. Preferably the aggregates contain from about 1 up to about 40 volume % of a sizing agent, more preferably from about 3 up to about 30 volume %, and most preferably from about 5 up to about 20 volume %. The rest of the volume of the aggregates is believed to contain primarily water, and minor amounts of coagulation agent and optionally dispersing/stabilising agents from the aqueous sizing dispersion. According to common practice, sizing particles of dispersions which are larger or considerably larger that sizing particles in the micron range, around 1 μm, cause poor distribution of the sizing agent in the paper web, eventually leading to impaired sizing of the paper. However, it is assumed that the aggregates comprised in the composition of the present, having the sizing agent evenly distributed within the aggregates, provide for effective spreading of the sizing agent at reasonable dosage of the composition over the fibre surface during the drying phase.

By mixing the aqueous solution containing the coagulant and the aqueous dispersion comprising a sizing agent, flocculation of the sizing agent occurs, whereby a composition is obtained comprising aggregates of the sizing agent suitably having a weight average diameter of at least about 5 μm, suitably at least about 10 μm, more preferably at least about 15 μm, optionally at least about 22 μm. The upper weight average diameter of the aggregates can vary significantly depending on process parameters such as type of cellulosic suspension and other performance chemicals added to the suspensions like dry strength agents, wet strength agents, etc. For practical reasons the weight average diameter of the aggregates is suitably below 250 μm, preferably below 100 μm, more preferably below 80 μm. Preferred ranges of the weight average diameter of the aggregates are from about 10 μm up to about 100 μm, suitably from about 15 μm up to about 60 μm, more preferably from about 22 μm up to about 50 μm.

The weight average diameter of the aggregates is measured using a Malvern Mastersizer Microplus (Malvern Instruments Ltd.) with a small volume cell top. By weight average diameter in the claims is meant the particle size distribution presented as PSD D(v.0.5), representing a volume weighted particle size for which 50% of the particles is below the value given.

The charged coagulation agent is preferably selected from the group consisting of polyelectrolytes, silica-based particles, inorganic aluminium-containing compounds, and mixtures thereof.

According to the preferred embodiment the composition of the charged aqueous dispersion comprising a sizing agent is not critical as long as the overall charge is cationic or anionic. The dispersion suitably comprises compounds which facilitate the formation of dispersed sizing particles and stabilises the sizing particles. Such dispersing/stabilising agents are preferably naturally polymers such as polysaccharides like cellulose derivatives and starches, and synthetic polymers, i.e. vinyl addition polymers and condensation polymers. The particle size of the sizing agent of the dispersion may range from about 0.1 up to about 2 $\mu$m. Furthermore, the charged aqueous dispersion may further to the above mentioned stabilising/dispersion agents or instead of such agents contain any of the agents referred to as coagulation agents in this application. The type and amount of dispersion/stabilising agents and/or coagulation agents of the dispersion are so chosen that the dispersion is rendered anionic or cationic. The charge of the dispersion is suitably measured by particle micro electrophoresis.

Preferred charged coagulation agents are polyelectrolytes which can be cationic or anionic, i.e. having an overall anionic or cationic charge. The polyelectrolyte comprised in the aqueous solution has suitably a weight average molecular weight of at least about 6,000, preferably at least about 10,000 and is commonly water-dispersible or water-soluble. Usually, the weight average molecular weight is below about 10,000,000 and more preferably from about 100,000 up to about 1,000,000. The polyelectrolyte may have a charge density of at least about 0.1 meq/g. Common charge densities range from about 0.1 up to about 18 meq/g, more preferably from about 0.1 up to about 12 meq/g, typically from about 0.5 up to about 6 meq/g. The cationic or anionic polyelectrolyte may also have charged groups of the opposite charge, commonly referred to as amphoteric polyelectrolytes. The charged polyelectrolyte is suitably selected from the group consisting of polysaccharides, vinyl addition polymers, condensation polymers, and mixtures thereof.

If cationic polyelectrolytes are present in the solution comprising the coagulation agent they may be of similar type or a mixture of different cationic polyelectrolytes. The cationic polyelectrolyte is suitably selected from the group consisting of polysaccharides, e.g. starches which can be derived from potato, corn, just to mention a few, suitably having tertiary amine groups, quaternary ammonium groups or reaction products of trimethylamine and epichlorohydrine; condensation polymers such as polyepihalohydrines, polyamideamines, poltethyleneimines, and the like, chain-reaction polymers exemplified by vinyladdition polymers, i.e. polyacrylamide, co-polymers of acrylates and acrylamide, diallyldimethylammonium chloride polymers referred to as poly-DADMAC.

Suitable anionic coagulation agents are selected from the group consisting of polyelectrolytes, silica-based particles, and mixtures thereof.

If anionic polyelectrolytes are comprised in the solution of the coagulation agent the anionic polyelectrolytes may constitute a mixture of different anionic polyelectrolytes or only a specific anionic polyelectrolyte. The anionic polyelectrolyte is suitably selected from the group consisting of polysaccharides, condesation polymers and chain-reaction polymers, preferably from the group consisting of polysaccharides, polysulfates, polysulfonates, and mixtures thereof. Suitable anionic polyelectrolyte are carboxylated cellulose, e.g. carboxymethylcellulose; phosphate modified polysaccharides, e.g. starch; polyacrylates such as polyacrylamides; polysulfates exemplified by polyvinyl sulfate, polyethylene sulfate, etc; polysulfonates like polyvinyl sulfonate, lignin sulfonate, condensated naphthalene sulfonate.

Coagulation agents from the group of silica-based particles, i.e. particles based on $SiO_2$, include inter alia colloidal silica, colloidal borosilicates, aluminium-modified silica or aluminium silicates, polyaluminosilicate microgels, and mixtures thereof. The silica-based particles are often referred to as silica sols. The particles can be colloidal, i.e. in the colloidal range of particle size, or preferably amorphous or essentially amorphous. The silica-based sols can also be modified and contain other elements, e.g. aluminium and/or boron, which can be present in the aqueous phase and/or in the silica-based particles. Suitable silica-based particles of this type include colloidal aluminium-modified silica and aluminium silicates. Mixtures of such suitable silica-based particles can also be used. Anionic silica-based particles are suitably structured anionic silica sols, where the silica particles can have a specific surface area within the range from 30 to 1200 $m^2/g$ and an S-value of typically within the range of from 8 to 45 percent, suitably from 10 to 35 percent and preferably from 10 to 30. The specific surface area can be measured by means of titration with NaOH in known manner, e.g. as described by Sears in Analytical Chemistry 28(1956):12, 1981–1983 and in U.S. Pat. No. 5,176,891, whereas the The given S-value can be measured and calculated as described by Iler, R. K. & Dalton, R. L. i J. Phys. Chem. 60(1956), 955–957. The S-value can be said to be a measure of the degree of aggregate or microgel formation and a lower S-value indicates a higher microgel content and can be seen as a measure of the amount of $SiO_2$, in percent by weight, in the disperse phase. The silica particles of the structured sols are commonly surface modified with aluminium to a degree of 2 to 25 percent, suitably from 3 to 20 percent. With an aluminium surface modification degree is meant the number of aluminium atoms which has replaced silicon atoms in the particle surface. The degree of modification is given in percent and is calculated on basis of 8 silanol groups per $nm^2$. This is described by Iler, R. K. in Journal of Colloidal and Interface Science, 55(1976):1, 25–34. The S-value given for the sols is to a high degree correlated to the particle size distribution.

Cationic silica-based particles, i.e. sols of cationic silica-based particles, are typically positively charged particles having a dense silica core coated/modified with one or different polyvalent metal-oxygen compounds including metal oxides, metal hydroxides and hydrated metal oxides. Preferably, the silica particles are coated with one polyvalent metal-oxygen compound, suitably with tri- and tetravalent metal-oxygen compound such as aluminium, chromium, gallium, titanium and zirconium, whereby aluminium is especially preferred. Suitable anionic counter ions include halides such as chloride, acetate or nitrate. Suitably, the positively charged colloidal silica particles are inorganic silica particles which may be surface-modified, preferably with aluminium such as various oxides and hydroxides of aluminium. The positively charged silica particles can have a particle size less than about 500 nm and usually greater than 1.0 nm. The specific surface area of the silica particles can be in the range of about 5 to about 1800 $m^2/g$, suitably in the range of from about 30 to about 1200 $m^2/g$ and more preferably from 50 to 1000 $m^2/g$. The positively charged colloidal aluminium-modified silica particles preferably have a weight ratio of $Al_2O_3$ to $SiO_2$ in the range from 1:20 up to 4:1, suitably from 1:10 up to 2:1 and most preferably in the range from 1:5 to 1:1.

Suitable inorganic aluminium-containing compounds functioning as coagulating agents are salts comprising aluminium such as aluminium sulphate, commonly referred to as alum, aluminium chloride and various inorganic polyaluminium compounds like polyaluminium chloride, polyaluminium chloride compounds containing sulphate and polyaluminium hydroxy silicate sulphate compounds. Polyaluminium compounds are based on aluminium, hydroxy groups and anions, they are termed basic and in aqueous solutions they are polynuclear complexes.

Examples of polyaluminium compounds can have the general formula $$Al_n(OH)_mX_{3n-m}$$

wherein X is a negative ion such as chloride or acetate and both n and m are positive integers so that $3_{n-m}$ is greater than 0. Preferably $X=Cl^-$ and such polyaluminium compounds are known as polyaluminium chlorides (PAC). Polyaluminium chlorides can also contain anions from sulphuric acid, phosphoric acid, polyphosphoric acid, chromic acid, di-chromic acid, silicic acid, citric acid, carboxylic acids or sulphonic acids. Examples of polyaluminium sulphates are those with the formula $[Al(OH)_x(SO_4)_y(H_2O)_z]_n$ wherein x has a value of 1.5 to 2.0, y a value of 0.5 to 0.75, x+2y=3 and z=1.5-4, suitably 1.5–3.0. Commercially available inorganic aluminium-containing compounds are e.g. Ekoflock, produced and sold by Eka Chemicals AB, Sachtoklar®, sold by Sachtleben Chemie in Germany, the sulphate-containing WAC sold by Atochem in France, the highly basic polyaluminium chloride compound Locron sold by Hoechst AG in Germany, poly(hydroxyaluminium)sulphate Omniklir, sold by OmniKem, USA, Niaproof, which is an aluminium hydroxy acetate, sold by Niacet in the USA and Alzofix which is based on polyaluminium chloride and dicyandiamide, sold by SKW Trostberg, Germany.

If inorganic aluminium-containing compounds are present in the aqueous dispersion of the sizing agent, the sizing agent may be flocculated by changing the pH of the dispersion with the addition of a suitable acid or base. Commonly, sizing dispersions containing aluminium-containing compounds are acidic, i.e. the dispersions have a pH in the range from 2–5. Accordingly, by increasing the pH of acidic dispersion, suitably to neutral levels (pH from 6 to 7.5) or even to slightly alkaline levels (pH from 8 to 10) flocculation of the sizing agent can be induced.

The type of sizing agent comprised in the aqueous dispersion is not critical, thus, any sizing agent known to the skilled person may be used such as non-cellulose-reactive agents including rosins, e.g. fortified and/or esterified rosins, waxes, fatty acids and resin acid derivatives, e.g. fatty amides and fatty esters, e.g. glycerol triesters of natural fatty acids, and cellulose-reactive agents. However, preferred sizing agents comprised in the aqueous dispersion are cellulose-reactive sizing agents. Suitable cellulose-reactive sizing agents are selected from the group consisting of hydrophobic ketene dimers, ketene dimer multimers, acid anhydrides, organic isocyanates, carbamoyl chlorides and mixtures thereof, more preferably from the group consisting of ketene dimers and acid anhydrides, most preferably ketene dimers. Suitable ketene dimers have the general formula (I) below, wherein $R^1$ and $R^2$ represent saturated or unsaturated hydrocarbon groups, usually saturated hydrocarbons, the hydrocarbon groups suitably having from 8 to 36 carbon atoms, usually being straight or branched chain alkyl groups having 12 to 20 carbon atoms, such as hexadecyl and octadecyl groups. The ketene dimers may be liquid at ambient temperature, i.e. at 25° C., suitably at 20° C. Commonly, acid anhydrides can be characterized by the general formula (II) below, wherein $R^3$ and $R^4$ can be identical or different and represent saturated or unsaturated hydrocarbon groups suitably containing from 8 to 30 carbon atoms, or $R^3$ and $R^4$ together with the —C—O—C— moiety can form a 5 to 6 membered ring, optionally being further substituted with hydrocarbon groups containing up to 30 carbon atoms. Examples of acid anhydrides which are used commercially include alkyl and alkenyl succinic anhydrides and particularly isooctadecenyl succinic anhydride.

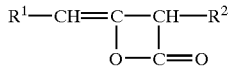

(I)

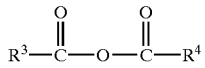

(II)

Suitable ketene dimers, acid anhydrides and organic isocyanates include the compounds disclosed in U.S. Pat. No. 4,522,686, which is hereby incorporated herein by reference. Examples of suitable carbamoyl chlorides include those disclosed in U.S. Pat. No. 3,887,427 which is also incorporated herein by reference.

Another preferred embodiment of the present invention refers to a process for sizing paper comprising providing an aqueous suspension comprising cellulosic fibres, dewatering said aqueous suspension thereby forming a paper web, said process comprising adding to the cellulosic suspension an aqueous composition comprising aggregates comprising a sizing agent, the composition obtainable by mixing in any order prior to the addition to the aqueous suspension, (i) an aqueous solution comprising at least an anionic coagulating agent, and (ii) a cationic aqueous dispersion comprising a sizing agent, wherein the zeta potential of the composition is less than 20 mV.

Consequently, a preferred aqueous sizing composition of the present invention is an aqueous sizing composition containing aggregates comprising a sizing agent, wherein the composition is obtainable by mixing in any order (i) a solution comprising at least one anionic coagulation agent, and (ii) a cationic aqueous dispersion comprising a sizing agent, wherein the zeta potential of the composition is less than 20 mV Preferably, the anionic coagulation agent is an anionic polysaccharide, i.e. an anionic derivative of cellulose such as carboxymethylcellulose having a charge density commonly from about 0.5 up to about 18 meq/g, more preferably from about 1.0 up to about 6 meq/g. The cationic aqueous dispersion suitably comprises a cationic polyelectrolyte, suitably cationic condensation polymers exemplified by epihalohydrine-type polymers (i.e. polyamines), amideamine-type polymers and ethyleneimine-type polymers. Depending on the monomers used the cationic polymers can be branched or non-branched. It is preferred that the cationic polyelectrolyte has a charge density ranging from about 0.5 up to about 20 meq/g, typically from about 1.0 up to about 12 meq/g, and preferably from about 1.0 up to about 6 meq/g. Preferred cationic condensation polymers include polyamideamine like those formed from aliphatic amines and aliphatic dicarboxylic acids, e.g. condensation of adipic acid, ethylene diamine or hexamethylene diamine and diethylene triamine; polyamideamine epichlorohhydrine resins, polyethylene imine, vinylamine-type polymers. Generally, larger particles containing the sizing agent are formed (better flocculation) if the charge density of the cationic polymer(s) present in the dispersion and/or the charge density of the coagulation agent is/are increased.

The aqueous composition comprising aggregates comprising a sizing agent is obtained by providing a charged aqueous dispersion comprising the sizing agent and an aqueous solution comprising a coagulating agent and mixing them. The aqueous dispersion is produced by applying known dispersion/emulsion techniques. The dispersion is suitably formed by providing the sizing agent in melted form and dispersing the liquid sizing agent in an aqueous solution comprising dispersing agents using a high pressure equipment. If sizing agents are used which are solid at ambient temperatures they are melted prior to emulsification.

As to the aqueous solution comprising the coagulation agent these are formed by simply mixing the water dispersible or water-soluble agent, optionally together with suitable dispersing agents, in the aqueous solution. The amount of coagulation agent present in the solution is not critical. Suitably the amount of coagulation agent present in the solution is from about 0.01 up to about 15 weight %.

The aqueous dispersion which is mixed with the aqueous solution containing the coagulation agent typically has a content of sizing agent from about 0.1 up to about 50% by weight, suitably from about 1.0 up to 20% by weight.

The sizing agent is suitably present in the composition of ail embodiments in an amount of from about 0.01 up to about 20% by weight based on total composition, preferably from about 0.07 up to about 5% by weight, even more suitably from about 0.1 up to about 2% by weight, whereas the coagulation agent typically is present in the composition in an amount ranging from about 0.1 to about 10% by weight based on the sizing agent, preferably from 0.1 to 5% by weight.

The process of this invention is used for the production of paper. The term "paper", as used herein, of course include not only paper and the production thereof, but also other sheet or web-like products, such as for example board and paperboard, and the production thereof. The process can be used in the production of paper from different types of suspensions of cellulose-containing fibres and the suspensions should suitably contain at least 25% by weight and preferably at least 50% by weight of such fibres, based on dry substance. The suspensions can be based on fibres from chemical pulp such as sulphate, sulphite and organosolv pulps, mechanical pulp such as thermomechanical pulp, chemothermomechanical pulp, refiner pulp and groundwood pulp, from both hardwood and softwood, and can also be based on recycled fibres, optionally from de-inked pulps, and mixtures thereof. The invention is particularly useful in the manufacture of paper from suspensions based on pulps comprising recycled fibres and de-inked pulp, and the content of cellulosic fibres of such origin can be up to 100%, suitably from 20% to 100%.

It has also been found that the process of the invention can be used for sizing paper from a suspension containing cellulosic fibers, and optional fillers, having a high cationic demand and/or a high conductivity. Sufficient sizing of the paper is obtained if the cationic demand of the suspension is above about 1000 $\mu$eq/l, and even if the cationic demand of the suspension is above about 2000 $\mu$eq/l, suitably above about 3000 $\mu$eq/l, preferably above about 4000 $\mu$eq/1. Furthermore, the conductivity of the stock can be at least 0.20 mS/cm, preferably at least 3.5 mS/cm. Very good sizing results have been observed at conductivity levels above 5.0 mS/cm and even above 7.5 mS/cm. The cationic demand can be measured by polyelectrolyte titration (Mütek PC 02). The conductivity can be measured by standard equipment such as, for example a WTW LF 539 instrument supplied by Christian Berner. The values referred to above are suitably determined by measuring the cationic demand or conductivity of the cellulosic suspension that is fed into or present in the headbox of the paper machine or, alternatively, by measuring the cationic demand or conductivity of white water obtained by dewatering the suspension. High conductivity levels mean high contents of salts (electrolytes), where the various salts can be based on mono-, di- and multivalent cations like alkali metals, e.g. $Na^+$ and $K^+$, alkaline earths, e.g. $Ca^{2+}$ and $Mg^{2+}$, aluminium ions, e.g. $Al^{3+}$, $Al(OH)^{2+}$ and polyaluminium ions, and mono-, di- and multivalent anions like-halides, e.g., $Cl^-$, sulfates, e.g. $SO_4^{2-}$ and $HSO_4^-$, carbonates, e.g. $CO_3^{2-}$ and $HCO_3^-$, silicates and lower organic acids, whereas high cationic demand signifies high amounts of anionic polyelectrolytes such as xylanes. The invention is particularly useful in the manufacture of paper from stocks having high contents of salts of di- and multivalent cations, and usually the cation content is at least 200 ppm, suitably at least 300 ppm and preferably at least 400 ppm. The salts can be derived from the cellulosic fibres and fillers used to form the stock, in particular in integrated mills where a concentrated aqueous fibre suspension from the pulp mill normally is mixed with water to form a dilute suspension suitable for paper manufacture in the paper mill. The salt may also be derived from various additives introduced into the stock, from the fresh water supplied to the process, or be added deliberately, etc. Further, the content of salts is usually higher in processes where white water is extensively recirculated, which may lead to considerable accumulation of salts in the water circulating in the process.

The present invention further encompasses papermaking processes where white water is extensively recirculated (recycled), i.e. with a high degree of white water closure, for example where from 0 to 30 tons of fresh water are used per ton of dry paper produced, usually less than 20, suitably less than 15, preferably less than 10 and notably less than 5 tons of fresh water per ton of paper. Recirculation of white water obtained in the process suitably comprises mixing the white water with cellulosic fibres and/or optional fillers to form a suspension to be sized; preferably it comprises mixing the white water with a suspension containing cellulosic fibres, and optional fillers, before the suspension enters the forming wire for sizing.

The invention is further illustrated in the following examples which, however, are not intended to limit the same. % refers to % by weight if not otherwise indicated.

In all examples the weight average diameter of the particles comprising the sizing agent was measured using a Malvern Mastersizer Microplus (Malvern Instruments Ltd) with a small volume cell top. The relative particle refractive index for the ketene dimer (AKD) particles was set to 1.15, the imaginary refractive index was set to 0.1 and the refractive index for the dispersing medium (water) was set to 1.33. The data were analysed according to a polydisperse model, 5OHD. The particle weight average diameter, i.e. the particle size distribution, was presented as PSD D(v.0.5), representing a volume weighted particle size for which 50% of the particles is below the value. The amount of particles comprising the sizing agent (flocks) was calculated using a Coulter Counter Multisizer II, Coulter International Corporation, USA.

EXAMPLE 1

A pre-flocculated sizing composition according to the invention was produced by mixing to 100 ml of a potassium sulphate solution (0.3 g/l potassium sulphate) a) an aqueous solution containing 0.092 mg/l of carboxymethylcellulose (CMC) having a charge density of 3.6 meq/g and a weight average molecular weight of 250000, and b) a cationic sizing dispersion containing a standard ketene dimer (AKD), a cationic polyamine and naphthalene sulphonate. The CMC solution was added to the dispersion in an amount to effect charge neutralisation of the composition. The charge of the composition was measured using PCD (Particle Charge Detector, Mütek PC 02). The obtained sizing composition had an amount of 0.025% of the ketene dimer. The weight average diameter of the particles of the composition comprising the ketene dimer sizing agent was around 30 $\mu$m. The aggregates of the composition contained about 10 volume % of the sizing agent. The volume % was calculated as follows: The weight average particle diameter of the particles was 30 $\mu$m which gives a volume of the particles of 1.4 E-14 $m^3$. The weight of an aggregate was determined by dividing the total amount of sizing agent in a specific volume by the total amount of particles in that specific volume. The amount of particles was determined by the use of a Coulter Counter. The weight of one particle was calculated to 1.45 E-12 kg giving a density of the aggregate (weight of particle/volume of particle) of around 100 kg/$m^3$. The density for the used AKD is 960 kg/$m^3$ The volume % was obtained by dividing the density of the aggregate with the density for the AKD, i.e. around 10 volume %.

For comparative purposes a non-flocculated cationic ketene dimer sizing dispersion was provided by using the same sizing dispersion which was pre-flocculated, however, without mixing the sizing dispersion with neither the CMC solution nor the potassium sulphate solution. The weight average diameter of the ketene dimer particles was 0.77 $\mu$m.

The sizing efficiencies of the pre-flocculated composition and the non-flocculated dispersion were evaluated by adding the composition and the dispersion to a furnish in amount which are evident in the tables 1 and 2 containing hard wood (HW) and soft wood (SW) sulphate pulp in a weight ratio of 60:40, having a pH of 8.0, a conductivity of 480 $\mu$S/cm, a concentration of 0.511% (w/w) based on dry fibres and 0.3 g/l of potassium sulphate. No retention agents were added to the suspensions. The paper sheets, having a grammage of 70 g/$m^2$, was formed using a Finnish Sheet former.

TABLE 1

Evaluation of sizing performance of pre-flocculated sizing composition.

| Sheet No. | Added pre-flocculated AKD, [kg/tonne dry fibres] | COBB-60 |
|---|---|---|
| 1 | 0.2 | 109 |
| 2 | 0.25 | 90 |
| 3 | 0.3 | 59 |
| 4 | 0.35 | 51 |
| 5 | 0.4 | 33 |
| 6 | 0.5 | 28 |
| 7 | 0.8 | 24 |

TABLE 2

Evaluation of sizing performance of non-flocculated sizing dispersion.

| Sheet No. | Added non-flocculated AKD, [kg/tonne dry fibres] | $COBB_{60}$ |
|---|---|---|
| 1 | 0.4 | 105 |
| 2 | 0.8 | 85 |
| 3 | 1.2 | 32 |
| 4 | 1.6 | 27 |
| 5 | 2.0 | 25 |

EXAMPLE 2

The same ketene dimer sizing dispersion used example 1 was flocculated by adding a solution of an anionic aluminium modified silica sol (NP590). The pre-flocculated composition was manufactured according to the method outlined in example 1. Similar paper suspensions as in example 1 were used.

TABLE 3

Sizing evaluation of sizing dispersion pre-flocculated with NP590.

| Sheet No. | Added pre-flocculated AKD, [kg/tonne dry fibres] | $COBB_{60}$ |
|---|---|---|
| 1 | 0.4 | 90 |
| 2 | 0.5 | 78 |
| 3 | 0.6 | 54 |
| 4 | 0.7 | 46 |
| 5 | 0.8 | 32 |

EXAMPLE 3

A cationic sizing dispersion containing 8.9% of a standard ketene dimer sizing agent and 1.1% of polyamideamine having a charge density of 640 $\mu$eq/g was flocculated by the addition of 0.120 g CMC/g total dispersion in a Britt Dynamic Drainage Jar (BDDJ), Paper research Materials Inc. The resulting composition was stirred at 1000 rpm for 3 minutes. The same cationic dispersion containing polyamideamine, however not pre-flocculated, was used for comparative purpose. The weight average diameter of the particles containing the sizing agent was 20 $\mu$m (pre-flocculated composition) and 0.8 $\mu$m (non-flocculated dispersion).

The sizing efficiency of the pre-flocculated composition and cationic dispersion were evaluated by measuring the $Cobb_{60}$ (SCAN-P 12:64) of laboratory sheets made in a Formette Dynamique (Centre Technique du Papier, France). The sheets were formed by adding the pre-flocculated composition and the non-flocculated, respectively, to the stock based in amounts indicated by tables 4 or 5. The paper stock contained TCF (totally chlorine free) birch pulp and had a concentration of 0.15% (w/w), a pH of 7.5-7.7 and a conductivity in the range of 1000-1200 $\mu$S/cm.

TABLE 4

Sizing evaluation pre-flocculated composition.

| Sheet No. | Added pre-flocculated AKD, [kg/tonne dry fibres] | $COBB_{60}$ |
|---|---|---|
| 1 | 1.6 | 26 |
| 2 | 4.8 | 25 |

TABLE 5

Sizing evaluation non-flocculated composition.

| Sheet No. | Added non-flocculated AKD, [kg/tonne dry fibres] | $COBB_{60}$ |
|---|---|---|
| 1 | 1.6 | 193 |
| 2 | 4.8 | 119 |

What is claimed is:

1. A process for sizing paper comprising providing an aqueous suspension comprising cellulosic fibres, dewatering said aqueous suspension thereby forming a paper web, said process comprising adding to the cellulosic suspension an aqueous composition comprising aggregates comprising a sizing agent, the composition obtainable by mixing in any order prior to the addition to the aqueous suspension.

(i) an aqueous solution comprising at least one coagulation agent, and (ii) an aqueous dispersion comprising a sizing agent, wherein the zeta potential of the composition is less than 20 mV.

2. A process according to claim 1, wherein the zeta potential of the composition is less than 18 mV.

3. A process according to claim 1, wherein the zeta potential of the composition is less than 15 mV.

4. A process according to claim 1, wherein the weight average diameter of the aggregates is at least about 5 $\mu$m.

5. A process according to claim 1, wherein the weight average diameter of the aggregates is from about 22 $\mu$m up to 250 $\mu$m.

6. A process according to claim 1, wherein the sizing agent is a cellulose-reactive sizing agent.

7. A process according to claim 6, wherein cellulose-reactive sizing agent is selected from the group consisting of ketene dimers, ketene dimer multimers, acid anhydrides, organic isocyanates, carbamoyl chloride and mixtures thereof.

8. A process according to claim 6, wherein cellulose-reactive sizing agent is selected from the group consisting of ketene dimers and acid anhydrides.

9. A process according to claim 1, wherein the coagulation agent is a charged coagulation agent having the opposite charge with respect to the aqueous dispersion.

10. A process according to claim 9, wherein the charged coagulation agent is anionic and the charged aqueous dispersion is cationic.

11. A process according to claim 10, wherein the anionic coagulation agent is selected from the group consisting of polyelectrolytes, silica-based particles, and mixtures thereof.

12. A process according to claim 10, wherein the charged coagulation agent is an anionic polyelectrolyte.

13. A process according to claim 12, wherein the anionic polyelectrolyte is selected from the group consisting of polysaccharides, polysulfates, polysulfonates, and mixtures thereof.

14. A process according to claim 12, wherein the anionic polyelectrolyte has a weight average molecular weight of at least about 6000.

15. A process according to claim 9, wherein the charged coagulation agent is cationic and the charged aqueous dispersion is anionic.

16. An aqueous sizing composition containing aggregates comprising a sizing agent, wherein the composition is obtainable by mixing in any order (i) a solution comprising at least one coagulation agent, and (ii) an aqueous dispersion comprising a sizing agent, wherein the zeta potential of the composition is less than 20 mV.

17. An aqueous sizing composition according to claim 16, wherein the zeta potential of the composition is less than 18 mV.

18. An aqueous sizing composition according to claim 16, wherein the zeta potential of the composition is less than 15 mV.

19. An aqueous sizing composition according to claim 16, wherein the weight average diameter of the aggregates is at least about 5 $\mu$m.

20. An aqueous sizing composition according to claim 16, wherein the weight average diameter of the aggregates is from about 22 $\mu$m up to 250 $\mu$m.

21. An aqueous sizing composition according to claim 16, wherein the sizing agent is a cellulose-reactive sizing agent.

22. An aqueous sizing composition according to claim 21, wherein cellulose-reactive sizing agent is selected from the group consisting of ketene dimers, ketene dimer multimers, acid anhydrides, organic Isocyanates, carbamoyl chloride and mixtures thereof.

23. An aqueous sizing composition according to claim 21, wherein cellulose-reactive sizing agent is selected from the group consisting of ketene dimers and acid anhydndes.

24. An aqueous sizing composition according to claim 16, wherein the coagulation agent is a charged coagulation agent having the opposite charge with respect to the aqueous dispersion.

25. An aqueous sizing composition according to claim 24, wherein the charged coagulation agent is anionic and the charged aqueous dispersion is cationic.

26. An aqueous sizing composition according to claim 24, wherein the charged coagulation agent is cationic and the charged aqueous dispersion is anionic.

* * * * *